US005954558A

United States Patent [19]

Osak

[11] Patent Number: 5,954,558

[45] Date of Patent: Sep. 21, 1999

[54] UNDERWATER VIEWING DEVICE

[76] Inventor: Raymond W. Osak, 4308 Sands Park, Kalkaska, Mich. 49646

[21] Appl. No.: 09/116,980

[22] Filed: Jul. 16, 1998

[51] Int. Cl.[6] ..... B63C 11/00

[52] U.S. Cl. ..... 441/135; 114/66

[58] Field of Search ..... 114/66; 441/135

[56] References Cited

U.S. PATENT DOCUMENTS

| | | | |
|---|---|---|---|
| 1,258,324 | 3/1918 | Egenes | 114/66 |
| 4,852,508 | 8/1989 | Takada | 114/66 |
| 5,145,431 | 9/1992 | Dowdeswell | 441/135 |
| 5,672,082 | 9/1997 | Binder | 441/135 |

*Primary Examiner*—Stephen Avila

[57] ABSTRACT

An underwater viewing device for use during ice fishing for permitting a user to see underwater through a hole in the ice. The device includes a viewing tube having open top and bottom ends. An annular resting flange is disposed around the viewing tube. An elastomeric O-ring is disposed around the viewing tube. The O-ring has a diameter sized such that the O-ring is held in tension on the viewing tube. The O-ring is positioned on the viewing tube between the top end of the viewing tube and the resting flange with the O-ring resting on the viewing tube such that the viewing flange is held in a relative position with respect to the resting flange.

9 Claims, 3 Drawing Sheets

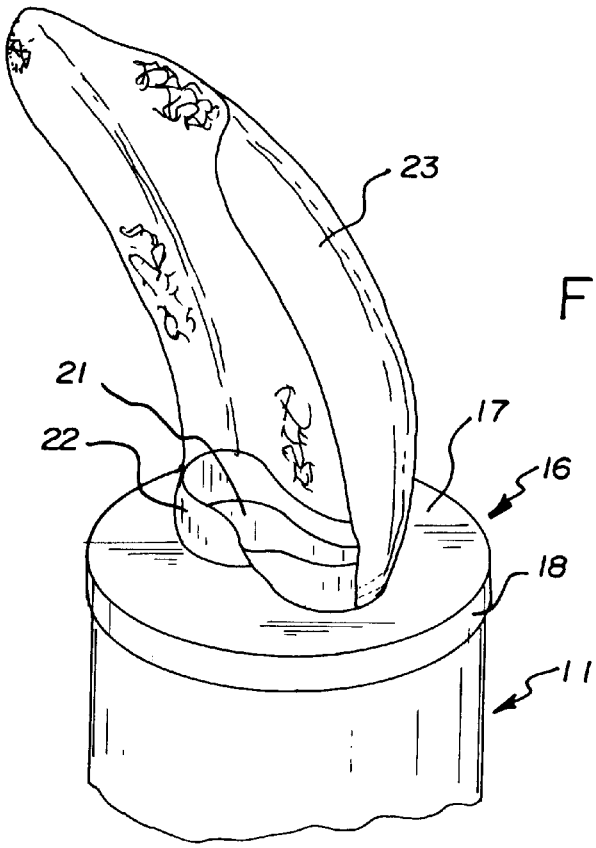
FIG. 5
FIG. 6
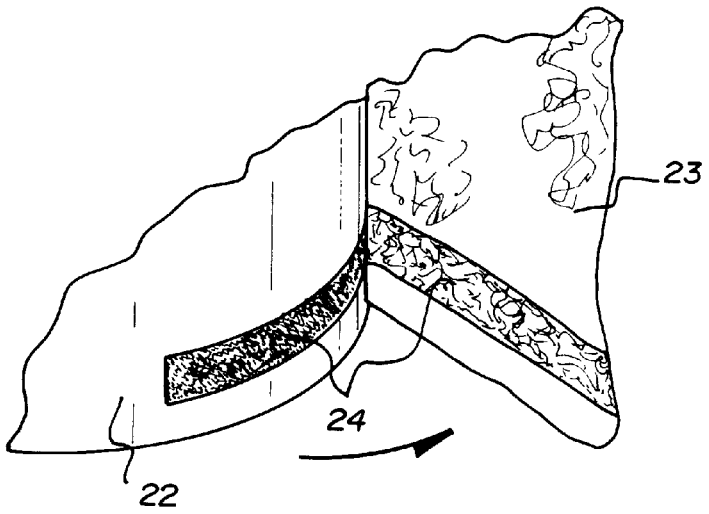

UNDERWATER VIEWING DEVICE

BACKGROUND OF THE INVENTION

1. Field of the Invention

The present invention relates to underwater viewing devices and more particularly pertains to a new underwater viewing device for use during ice fishing for permitting a user to see underwater through a hole in the ice.

2. Description of the Prior Art

The use of underwater viewing devices is known in the prior art. More specifically, underwater viewing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art underwater viewing devices include U.S. Pat. No. 2,795,165; U.S. Pat. No. 4,145,783; U.S. Pat. No. 5,145,431; U.S. Pat. No. 5,672,082; U.S. Pat. No. Des. 311,410; and U.S. Pat. No. 2,343,473.

While these devices fulfill their respective, particular objectives and requirements, the aforementioned patents do not disclose a new underwater viewing device. The inventive device includes a viewing tube having open top and bottom ends. An annular resting flange is disposed around the viewing tube. An elastomeric O-ring is disposed around the viewing tube. The O-ring has a diameter sized such that the O-ring is held in tension on the viewing tube. The O-ring is positioned on the viewing tube between the top end of the viewing tube and the resting flange with the O-ring resting on the viewing tube such that the viewing flange is held in a relative position with respect to the resting flange.

In these respects, the underwater viewing device according to the present invention substantially departs from the conventional concepts and designs of the prior art, and in so doing provides an apparatus primarily developed for the purpose of use during ice fishing for permitting a user to see underwater through a hole in the ice.

SUMMARY OF THE INVENTION

In view of the foregoing disadvantages inherent in the known types of underwater viewing devices now present in the prior art, the present invention provides a new underwater viewing device construction wherein the same can be utilized for use during ice fishing for permitting a user to see underwater through a hole in the ice.

The general purpose of the present invention, which will be described subsequently in greater detail, is to provide a new underwater viewing device apparatus and method which has many of the advantages of the underwater viewing devices mentioned heretofore and many novel features that result in a new underwater viewing device which is not anticipated, rendered obvious, suggested, or even implied by any of the prior art underwater viewing devices, either alone or in any combination thereof.

To attain this, the present invention generally comprises a viewing tube having open top and bottom ends. An annular resting flange is disposed around the viewing tube. An elastomeric O-ring is disposed around the viewing tube. The O-ring has a diameter sized such that the O-ring is held in tension on the viewing tube. The O-ring is positioned on the viewing tube between the top end of the viewing tube and the resting flange with the O-ring resting on the viewing tube such that the viewing flange is held in a relative position with respect to the resting flange.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new underwater viewing device apparatus and method which has many of the advantages of the underwater viewing devices mentioned heretofore and many novel features that result in a new underwater viewing device which is not anticipated, rendered obvious, suggested, or even implied by any of the prior art underwater viewing devices, either alone or in any combination thereof.

It is another object of the present invention to provide a new underwater viewing device which may be easily and efficiently manufactured and marketed.

It is a further object of the present invention to provide a new underwater viewing device which is of a durable and reliable construction.

An even further object of the present invention is to provide a new underwater viewing device which is susceptible of a low cost of manufacture with regard to both materials and labor, and which accordingly is then susceptible of low prices of sale to the consuming public, thereby making such underwater viewing device economically available to the buying public.

Still yet another object of the present invention is to provide a new underwater viewing device which provides in the apparatuses and methods of the prior art some of the advantages thereof, while simultaneously overcoming some of the disadvantages normally associated therewith.

Still another object of the present invention is to provide a new underwater viewing device for use during ice fishing for permitting a user to see underwater through a hole in the ice.

Yet another object of the present invention is to provide a new underwater viewing device which includes a viewing tube having open top and bottom ends. An annular resting flange is disposed around the viewing tube. An elastomeric O-ring is disposed around the viewing tube. The O-ring has a diameter sized such that the O-ring is held in tension on the viewing tube. The O-ring is positioned on the viewing tube between the top end of the viewing tube and the resting flange with the O-ring resting on the viewing tube such that the viewing flange is held in a relative position with respect to the resting flange.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic partial perspective view of the present invention with a cover sheet attached to the eye guard.

FIG. 6 is a schematic partial perspective view illustrating the preferred detachable attachment of the cover sheet to the eye guard of the present invention.

DESCRIPTION OF THE PREFERRED EMBODIMENT

Figure 1:
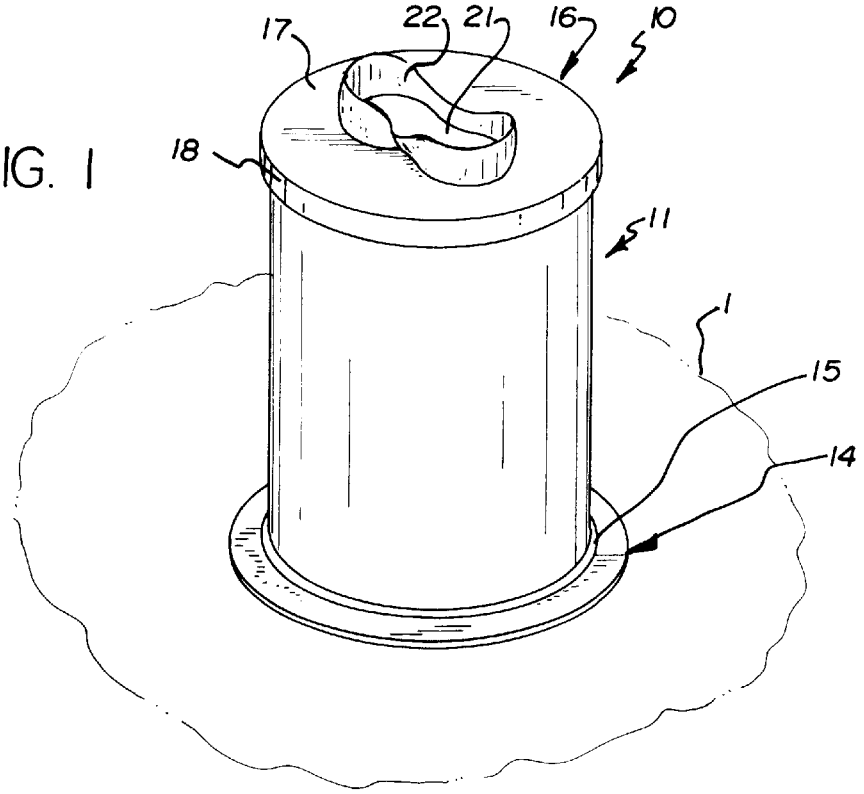
FIG. 1 is a schematic perspective view of a new underwater viewing device according to the present invention.
Figure 2:
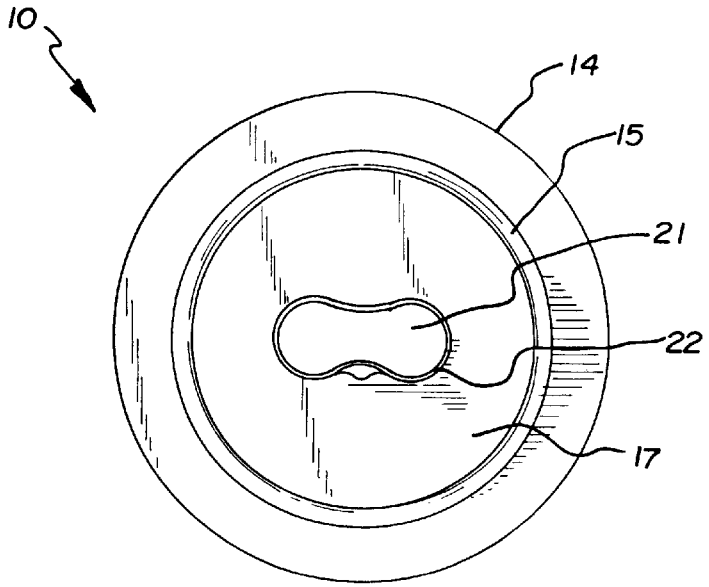
FIG. 2 is a schematic top view of the present invention.
Figure 3:
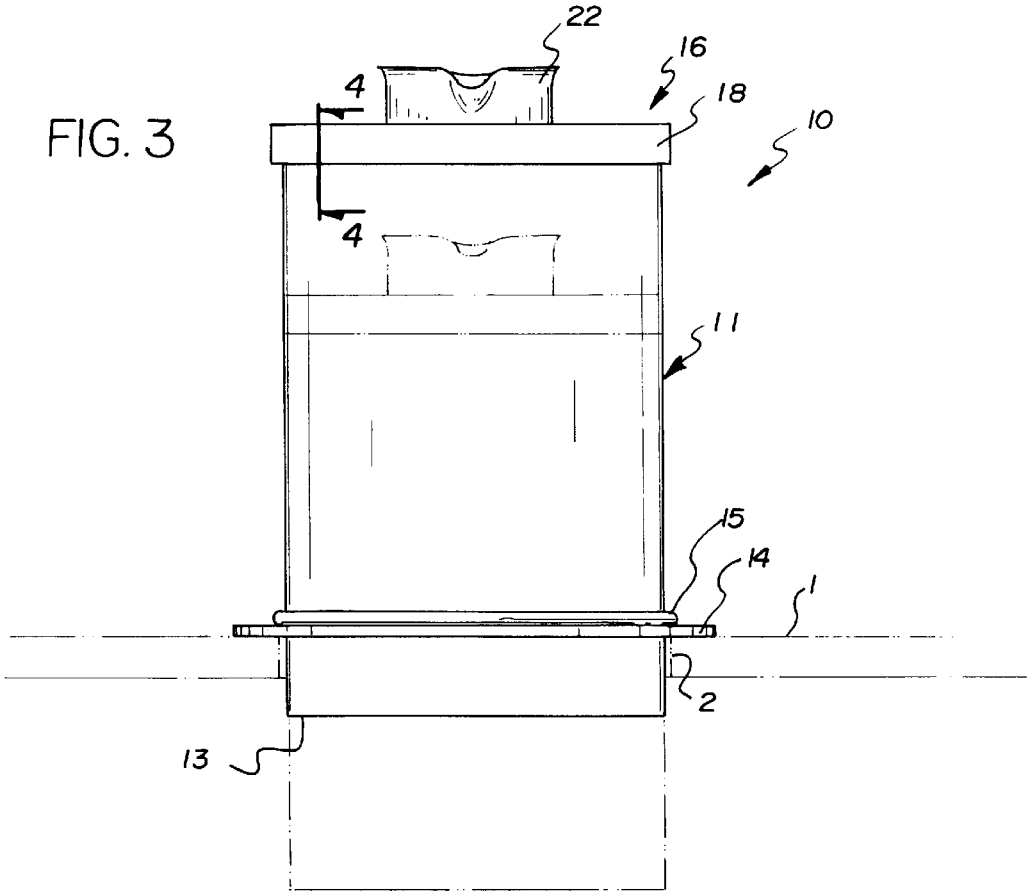
FIG. 3 is a schematic side view of the present invention.

With reference now to the drawings, and in particular to FIGS. 1 through 6 thereof, a new underwater viewing device embodying the principles and concepts of the present invention and generally designated by the reference numeral 10 will be described.

As best illustrated in FIGS. 1 through 6, the underwater viewing device 10 generally comprises a viewing tube 11 having open top and bottom ends 12, 13. An annular resting flange 14 is disposed around the viewing tube 11. An elastomeric O-ring 15 is disposed around the viewing tube 11. The O-ring 15 has a diameter sized such that the O-ring 15 is held in tension on the viewing tube 11. The O-ring 15 is positioned on the viewing tube 11 between the top end 12 of the viewing tube 11 and the resting flange 14 with the O-ring 15 rest ing on the viewing tube 11 such that the viewing flange is held in a relative position with respect to the resting flange 14.

In use, the underwater viewing device 10 is designed for insertion into a body of water through a hole 2 in ice 1 on the body of water. In closer detail, the viewing tube 11 is generally cylindrical and has a lumen, generally circular open top and bottom ends 12, 13, and a longitudinal axis extending between the top and bottom ends 12, 13 of the tube. The bottom end 13 of the viewing tube 11 is designed for inserting into a body of water through a hole 2 in the ice 1 over the body of water. The top end 12 of the viewing tube 11 is designed for permitting a user to look underwater through the viewing tube 11.

An annular resting flange 14 having generally circular inner and outer perimeters with the inner perimeter of the resting flange 14 defining a generally circular central space. The resting flange 14 is disposed around the viewing tube 11 such that the viewing tube 11 extends through the central space. The annular resting flange 14 is designed for resting on the ice 1 on the body of water around the periphery of the hole 2 in the ice 1.

An elastomeric O-ring 15 is disposed around the viewing tube 11. The O-ring 15 has a diameter sized such that the O-ring 15 is held in tension on the viewing tube 11. Preferably, the inner diameter of the O-ring 15 is less than the diameter of the viewing tube 11 such that the O-ring 15 is stretched around the circumference of the viewing tube 11 to hold the O-ring 15 on the viewing tube 11. The O-ring 15 is positioned on the viewing tube 11 between the top end 12 of the viewing tube 11 and the resting flange 14. The O-ring 15 is rested on the upper surface of the viewing tube 11 such that the viewing flange is held in an adjustable relative position with respect to the resting flange 14. In use, pushing downwards on the viewing tube 11 causes the O-ring 15 to be pushed up towards the top end 12 of the viewing tube 11 such that a greater portion of the length of the viewing tube 11 extends downwards from the resting flange 14. Conversely, in use, pulling upwards of the viewing tube 11 with respect to the resting flange 14 and pushing downwards of the O-ring 15 on the viewing tube 11 raises the relative position of the viewing tube 11 with respect to the resting flange 14 such that a lesser proportion of the length of the viewing tube 11 downwardly extends from the resting flange 14.

Figure 4:
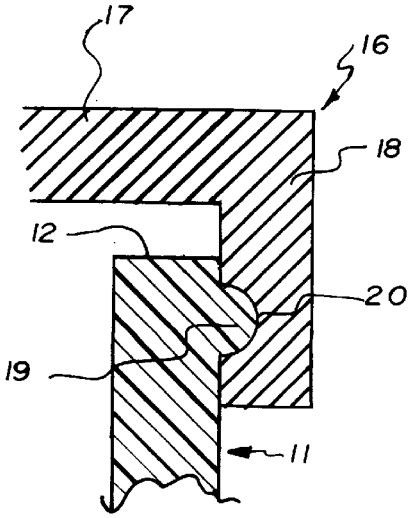
FIG. 4 is a schematic cross sectional view of the present invention taken from line 4—4 on FIG. 3.

A lid 16 substantially covers the top end 12 of the viewing tube 11. The lid 16 has a generally circular top panel 17 and a lower lip 18 downwardly extending around the perimeter of the top panel 17. The lower lip 18 extends around the viewing tube 11 when the lid covers the top of the viewing tube. Optionally, the lid 16 is attachable to the viewing tube 11. With reference to FIG. 4, in this optionally embodiment, the viewing tube 11 ideally has an annular ridge 19 therearound adjacent the top of the viewing tube 11 which is received by an annular groove 20 around the lip 18 of the lid 16 to detachably attach the lid 16 to the viewing tube 11.

The lid 16 has a spy hole 21 therethrough. The spy hole 21 is designed for permitting a user to look through the viewing tube 11 when the lid 16 covers the top end 12 of the viewing tube 11. I Preferably, the spy hole 21 of the lid 16 has a generally figure-eight-shaped periphery adapted for permitting a user to look through the viewing tube 11 with both eyes. Ideally, the spy hole is centered on the top panel of the lid along the longitudinal axis of the viewing tube. The lid 16 preferably has a eye guard 22 upwardly extending around the periphery of the spy hole 21 of the lid 16. In use, the eye guard 22 is designed for blocking external light from entering the viewing tube 11 when a user is looking through the spy hole 21 into the viewing tube 11. Ideally, a cover sheet 23 is coupled to the eye guard 22. The cover sheet 23 is designed for draping over the head of the user when the user is looking through the spy hole 21 into the viewing tube 11. Ideally, a hook and loop fastener 24 detachably couples the cover sheet 23 to the eye guard 22.

The viewing tube 11 has a length defined between the top and bottom ends 12, 13 of the viewing tube 11 and an outer diameter. The length of viewing tube 11 is greater than the outer diameter of the viewing tube 11. Preferably, the length of the viewing tube 11 is more than twice the outer diameter of the viewing tube 11, Even more preferably, the length of the viewing tube 11 is about four times greater than the outer diameter of the viewing tube 11. In an ideal illustrative embodiment, the length of the viewing tube 11 is about 24 inches and the outer diameter is about 6 inches. In this ideal illustrative embodiment, the resting flange 14 preferably has an inner diameter defined by the inner perimeter of slightly more than about 6 inches and an outer diameter defined by the outer perimeter of the resting flange 14 of about 10 inches such that the resting flange 14 has an ideal width defined between the inner and outer perimeter of about 2 inches. Ideally, the resting flange 14 has upper and lower surfaces defining a thickness of about ¾ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An underwater viewing device for insertion into a body of water through a hole in ice on the body of water, said underwater viewing device comprising:

a viewing tube having open top and bottom ends;

an annular resting flange being disposed around said viewing tube;

an elastomeric O-ring being disposed around said viewing tube, said O-ring having a diameter sized such that said O-ring is held in tension on said viewing tube;

said O-ring being positioned on said viewing tube between said top end of said viewing tube and said resting flange, said O-ring being rested on said viewing tube such that said viewing flange is held in a relative position with respect to said resting flange; and a lid substantially covering said top end of said viewing tube, said lid having a spy hole therethrough;

wherein said lid has a top panel and a lower lip downwardly extending around said top panel lid, said lower lip extending around said viewing tube.

2. The underwater viewing device of claim 1, wherein said viewing tube is generally cylindrical.

3. The underwater viewing device of claim 1, wherein said spy hole has a periphery, wherein said lid has an eye guard upwardly extending around said periphery of said spy hole of said lid.

4. The underwater viewing device of claim 3, further comprising a cover sheet being coupled to said eye guard.

5. The underwater viewing device of claim 4, wherein a hook and loop fastener detachably couples said cover sheet to said eye guard.

6. The underwater viewing device of claim 1, wherein said viewing tube has a length defined between said top and bottom ends of said viewing tube, wherein said viewing tube has an outer diameter, wherein said length of viewing tube is greater than said outer diameter of said viewing tube.

7. The underwater viewing device of claim 6, wherein said length of said viewing tube is more than twice said outer diameter of said viewing tube.

8. The underwater viewing device of claim 6, wherein said length of said viewing tube is about four times greater than said outer diameter of said viewing tube.

9. An underwater viewing device for insertion into a body of water through a hole in ice on the body of water, said underwater viewing device comprising:

a viewing tube being generally cylindrical and having a lumen, generally circular open top and bottom ends, and a longitudinal axis extending between said top and bottom ends of said tube;

an annular resting flange having generally circular inner and outer perimeters, said resting flange being disposed around said viewing tube;

an elastomeric O-ring being disposed around said viewing tube, said O-ring having a diameter sized such that said O-ring is held in tension on said viewing tube;

said O-ring being positioned on said viewing tube between said top end of said viewing tube and said resting flange, said O-ring being rested on said viewing tube such that said viewing flange is held in a relative position with respect to said resting flange;

a lid substantially covering said top end of said viewing tube, said lid having a generally circular top panel and a lower lip downwardly extending around said top panel lid, said lower lip extending around said viewing tube;

said lid having a spy hole therethrough, said spy hole of said lid having a generally figure-eight-shaped periphery;

said lid having a eye guard upwardly extending around said periphery of said spy hole of said lid;

a cover sheet being coupled to said eye guard, wherein a hook and loop fastener detachably couples said cover sheet to said eye guard; and wherein said viewing tube has a length defined between said top and bottom ends of said viewing tube, wherein said viewing tube has an outer diameter, wherein said length of said viewing tube is about four times greater than said outer diameter of said viewing tube.

* * * * *